United States Patent [19]

Sullivan

[11] 4,204,556

[45] May 27, 1980

[54] SELF-CONTAINED, AUTOMATIC PRIMER VALVE FOR SEWER LINE DRAIN TRAPS

[75] Inventor: Richard N. Sullivan, Portland, Oreg.

[73] Assignee: Precision Plumbing Products, Inc., Portland, Oreg.

[21] Appl. No.: 964,630

[22] Filed: Nov. 29, 1978

[51] Int. Cl.[2] ..... F16K 9/00; F16L 43/00

[52] U.S. Cl. ..... 137/206; 137/204; 137/247.25

[58] Field of Search ..... 137/206, 209, 204, 247.25

[56] References Cited

U.S. PATENT DOCUMENTS

| | | | |
|---|---|---|---|
| 2,571,420 | 10/1951 | Churchman | 137/204 |
| 3,333,597 | 8/1967 | Sullivan | 137/247.25 |
| 3,516,430 | 6/1970 | Valentine | 137/204 |

*Primary Examiner*—Alan Cohan

*Attorney, Agent, or Firm*—Eugene D. Farley

[57] ABSTRACT

A primer valve for sewer line drain traps comprises a case having an upper water inlet communicating with the pressurized house line and a lower water outlet communicating with the trap. The hollow interior of the case is divided into a lower valved dispensing chamber which dispenses water into the trap; an intermediate supply chamber which supplies water to the primer valve system, and an upper trapped-air chamber. The latter actuates the valve in the dispensing chamber and dispenses water to the trap each time the pressure in the house line drops.

8 Claims, 4 Drawing Figures

SELF-CONTAINED, AUTOMATIC PRIMER VALVE FOR SEWER LINE DRAIN TRAPS

BACKGROUND AND GENERAL STATEMENT OF THE INVENTION

This invention pertains to primer valves for dispensing small amounts of water from time to time to sewer line drain traps as required to keep them full and operative.

As is well known, the water in sewer line drain traps evaporates with time. Accordingly the traps may become non-functional, allowing sewer gas to enter the building in which the drain is housed. For this reason most municipal plumbing and sanitary codes require that means be provided for supplying priming water automatically to each sewer line water trap. This ensures that the trap will be operative at all times.

Prior art of interest relating to valves of the class useful in this application includes the following:

| U.S. Pat. No. | Inventor | Title |
|---|---|---|
| 208,379 | Downey, B. J. | Vacuum Valve for Stench Traps |
| 1,066,960 | Twyford, T. W. | Flushing Valve |
| 2,044,443 | Ott, O. W. | Means for Preventing Siphonic Action |
| 2,060,567 | Glenk, A. W. | Automatic Beverage Valve |
| 2,893,481 | Szydlowski, J. | System for Supplying Fuel for Turbojet Engines |
| 3,093,153 | Horowitz, C. | Quick Release Valve |
| 3,196,890 | Brandenberg, K. A. | Double Acting Check Valve |
| 3,333,597 | Sullivan, R. N. | Automatic Primer Valve for Drain Traps |
| 3,370,543 | Phillips, C. F. | Combined Pulsator Dome and Check Valve Assembly |
| 3,375,839 | Crenshaw, W. F. | Breathing Oxygen Mask Inhalation and Exhalation Diaphragm Valve Unit |
| 3,776,269 | Watts, James B. | Priming Unit for Distributing Priming Water to Multiple Sewer Line Water Traps |
| 3,580,273 | Schwarz, Ernest I. | Two Way Check Valve |
| 3,704,857 | Clarige, George Henry | Water Flow Silencing Means |
| 3,868,962 | Waterson, William | Back Flow Preventor |
| 3,905,386 | Rachocki, Eugene | Valve |
| 3,937,242 | Eckert, Konrad | Pressure Control Device for Controlling the Flow of a Fluid Medium |
| 3,985,836 | Fischer, Earl R. | Altitude Compensated Carburetor Float Valve |
| 4,013,089 | Braukmann, Heinz Werner | Back Flow Preventer Valve |

My prior U.S. Pat. No. 3,333,597 describes a primer valve for sewer line drain traps which is automatic in operation and overcomes two of the principal objections to conventional primer valves: the necessity of using calibrated metal springs which fail with use and the requirement that the primer valve be installed directly in a supply pipe which may be remote from the drain line to be primed.

However, neither this patent, nor any of the patents cited above, provide an automatic primer valve for sewer line drain traps which is self contained in a compact package; which may be installed in a small branch line; which is positive in its action; which accurately controls the amount of water dispensed to within small limits; and which contains no internal parts which are subject to excessive water corrosion and hence to failure with time.

It is the purpose of the present invention to provide an automatic primer valve for sewer line drain traps, including sumps and catch basins, having these advantages.

Generally stated, the primer valve assembly of my invention comprises an upright hollow case having at its upper end a water inlet communicating with the house water line and at its lower end a water outlet communicating with the trap. A ported partition divides the case interior into an upper, valve-actuating, trapped air chamber and a lower chamber.

A diaphragm divides the lower chamber into an upper water supply chamber and a lower water dispensing chamber. A valve seat on the water outlet is arranged in valve-former relation to the diaphragm. A check valve is seated in the partition port and arranged to check the flow of water from the valve-actuating chamber to the water supply chamber. A conduit interconnects the water inlet and the water supply chamber. A passageway for water is present between the valve-actuating chamber and the water-dispensing chamber.

In its use, all three chambers in the first instance are under the same pressure from the house line. When the pressure in the house line diminishes, as it does when a tap is opened, the trapped air valve actuating chamber transmits pressure to the diaphragm. This opens the valve, permitting the passage of a small amount of water from the dispensing chamber into the trap. As soon as this has been accomplished, the pressure in the chambers again is equalized, and the valve closes in readiness for another actuation.

DESCRIPTION OF A SPECIFIC EMBODIMENT OF THE INVENTION

Figure 3:
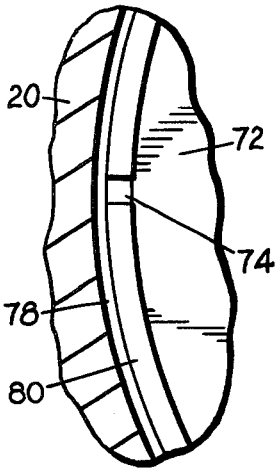
Figure 4:
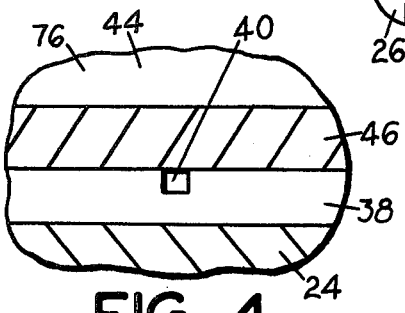
Figure 2:
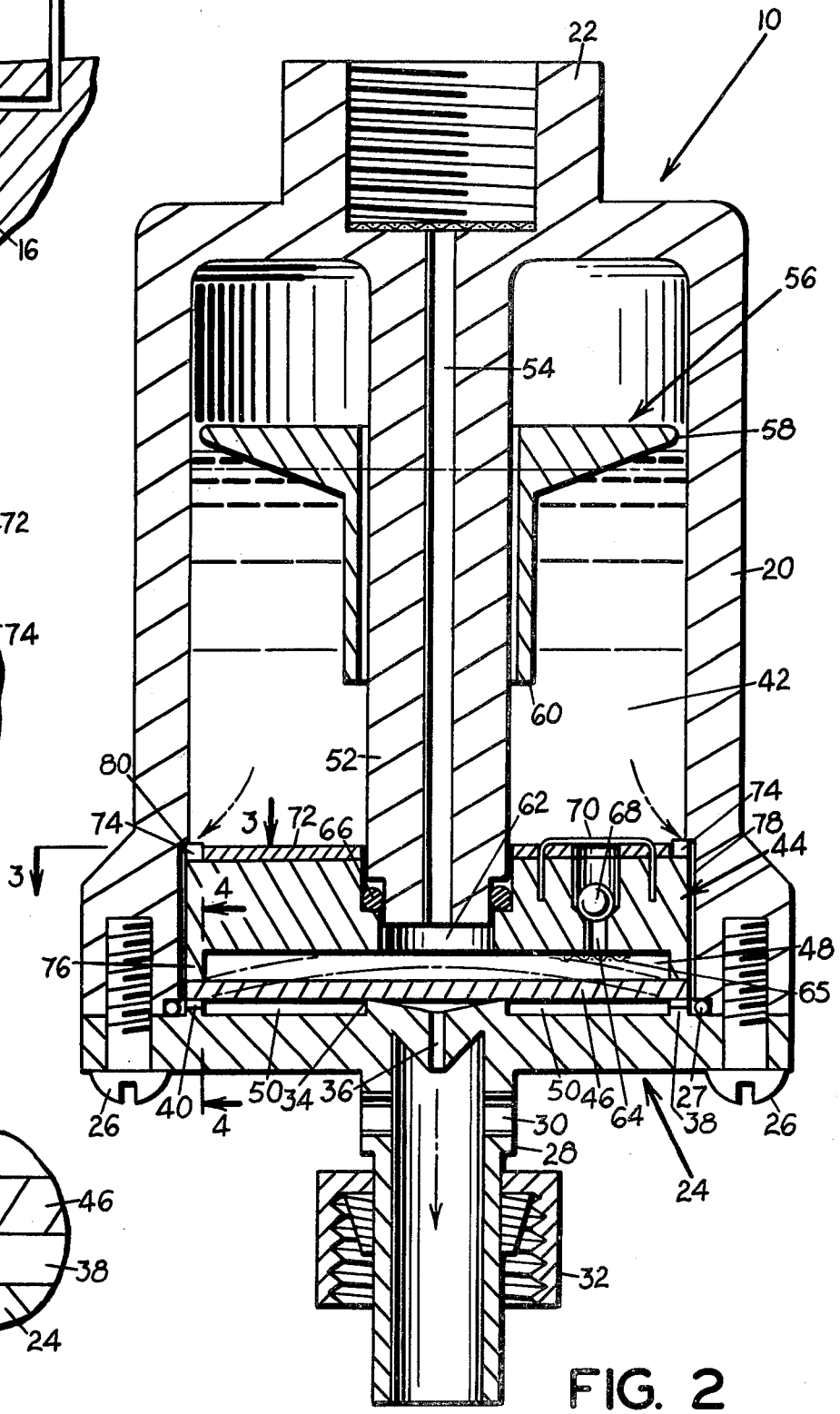
FIG. 2 is a view in longitudinal section, its water-retaining position being indicated in full outline and its water-dispensing position being illustrated in dashed outline.

FIGS. 3 and 4 are transverse sectional views taken along the lines 3—3 and 4—4 of FIG. 2, respectively.

Figure 1:
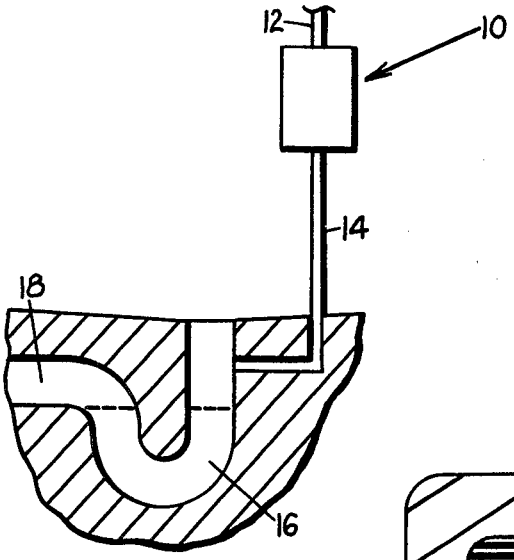
FIG. 1 is a schematic view showing the hereindescribed primer valve in a typical installation.

Referring to FIG. 1:

The hereindescribed primer valve is indicated generally at 10. At its upper end it is connected to the house line 12 which supplies it with water under house line pressure. At its lower end it is connected to outlet line 14 through which the valve dispenses water in small amounts to the trap 16 of a sewer line 18.

As shown in FIG. 2, the valve is contained in a hollow case 20. At its upper end case 20 has a threaded neck 22 with screen 23 by means of which it is connected to house line 12. The lower end of the case is open and covered with a cap indicated generally at 24.

The cap, with an O-ring 27 interposed, is bolted across the open end of the case by means of bolts 26. Its outer face is provided with an extension 28 through which are bored vacuum breaker ports 30. The extension is integral with or connected to outlet line 14 which leads to the trap to be primed. A stuffing box 32 is provided for sealed connection to line 14.

The inner surface of cap 24 is formed with a central valve seat 34 with opening 36 which communicates with extension 28.

Peripherally, the inner face of cap 24 has an annular rim 38 with radially spaced small slots 40.

The hollow interior of case 20 is divided by a partition indicated generally at 44 into an upper chamber 42, termed herein a trapped air valve-actuating chamber, and a lower chamber. The lower chamber in turn is divided by a diaphragm 46 into a water-supply chamber 48 and a water-dispensing chamber 50.

Valve-actuating chamber 42 is adapted to contain a quantity of water under pressure, with a quantity of trapped air compressed above. A central tube 52 extends the length of this chamber. The tube has a central bore 54 which at the upper end of the tube communicates with neck 22 of the case, and hence with the source of water under pressure. At its lower end the tube is open.

An air-water separator 56 is located within chamber 42. It is made of flotation material and comprises an annular, plate-shaped upper segment 58 and a depending sleeve segment 60. The separator is mounted for sliding movement on tube 52 and serves to separate and define the air and water phases contained in chamber 42.

Partition 44 preferably comprises a disc of plastic or other suitable structural material. It is formed with a central stepped bore 62 and with a radially-spaced stepped bore 64, with screen 65.

Stepped bore 62 receives and locates the terminal portion of tube 52. An O-ring 66 is provided as a seal between the two members.

Stepped bore 64 receives a ball 68 and with it forms a check valve permitting the flow of water into chamber 42 only. The check valve assembly is completed by means of a staple-type ball retainer 70.

The upper peripheral margin of partition 44 is formed with an upwardly extending rim 72. This is formed with a plurality of radially spaced small slots 74 which permit the passage of water.

The lower peripheral margin of disc 44 is provided with a rim 76.

The diameter of disc 44 is such as to provide a passageway 78 for water, communicating with slots 74 in rim 72 of the disc and slots 40 in rim 38 of the cap.

Thus the diameter of the disc is somewhat less than the diameter of that portion of the case in which it is located. However, the diameter of disc 44 is sufficient to ensure bearing engagement with a shoulder 80 in the interior of the case, provided for this purpose.

It is a feature of the invention that all of the above enumerated parts may be simply and inexpensively made of durable plastic. The assembly thus consists of but four molded plastic parts: case 20, cap 24, disc-shape partition 44, and float 56. No springs or other metal mechanical parts subject to deterioration with time and a water environment are present.

OPERATION

The operation of the self-contained automatic primer valve of my invention is as follows:

In assembling the valve, disc 44 is placed inside case 20 with its rim abutting shoulder 80. Diaphragm 46 is placed across the lower rim 76 of disc 44. Bolts 26 are tightened, thus clamping the margin of the diaphragm against the under margin of the disc so that the diaphragm can alternate between the open and closed positions of the valve.

When the valve is connected through neck 22 with house line water under pressure, the water passes down tube 52 into water supply chamber 48. Thence it passes through bore 64 in partition 44 and through the float check valve 68 therein into valve-actuating chamber 42.

Trapped air in this chamber is compressed at its upper end and maintained substantially separated from the water phase by means of float separator 56.

From valve-actuating chember 42 water filters through slits 74 in the upper rim 72 of disc 44, through peripheral passageway 78 between the disc and the side walls of case 20, and through slits 40 and rim 38 of cap 24. The water thus enters dispensing chamber 50.

The pressure in all three chambers now is equal and maintained by the pressure in house line 12. Since the effective water pressure on the upper surface of the diaphragm 46 is greater than the pressure on the lower surface thereof, the diaphragm is pressed across valve seat 34 in valve-forming relationship thereto, sealing off discharge pipe 14.

When the pressure in the house line is reduced, as when a tap is opened, or during seasonal pressure variations in the water system due to changing customer demands for water, the pressure balance in the valve is disturbed. The pressure on the upper surface of diaphragm 46 now is less than that on the underside of the diaphragm, since the latter pressure is maintained by the compressed air in chamber 42.

As a result, diaphragm 46 is forced into its upper, dashed line position of FIG. 1. This opens the valve of which it is a component part and permits the small quantity of water contained in the dispensing chamber and associated passageways to be discharged into outlet 14 and hence into the trap. Although the amount thus discharged is small, in the average household the discharges occur at frequent intervals sufficient in number to maintain water in the trap at the desired level. This is accomplished without undue waste of water since the action of the valve is such as to shut off positively the discharge of water once the initial pulse has been released.

This is accomplished by the action of check valve 68 and O-ring 66 which prevent the back flow of water contained in chamber 42. It is also accomplished by the action of diaphragm 46 which flips back to its closed full-line position as soon as the pressure in the chambers has been equalized.

The valve of the invention thus is fully automatic and self-adjusting in its operation. It does not continue dispensing water for the full period of time during which the pressure is reduced in the main line. It dispenses it for a brief interval only, then shuts it off.

Having thus described my invention in preferred embodiments, I claim:

1. A sewer drain trap primer valve comprising:

(a) an upright case having at its upper end a water inlet communicating with the house water line and at its lower end a water outlet communicating with the trap, (b) a ported partition dividing the case interior into an upper, valve-actuating, trapped air chamber and a lower chamber, (c) a diaphragm dividing the lower chamber into an upper, water-supplying chamber and a lower, water-dispensing chamber, (d) a valve seat on the water outlet arranged in valve-forming relation to the diaphragm, (e) a check valve in the partition port arranged to check the flow of water from the valve-actuating chamber to the water supply chamber, (f) a conduit interconnecting the water inlet and the water-supplying chamber, and (g) a passageway for water between the valve-actuating chamber and the water-dispensing chamber.

2. The primer valve of claim 1 wherein the conduit interconnecting the water inlet and the water supply chamber comprises a tube and connecting opening through the partition.

3. The primer valve of claim 1 wherein the partition comprises a disc having an opening transversely therethrough and the check valve comprises a ball check valve seated in the opening.

4. The primer valve of claim 1 wherein the partition comprises a disc and the conduit comprises a tube bearing against and positioning the disc at the lower end of the case.

5. The primer valve of claim 1 wherein the partition comprises a disc positioned in the lower chamber having a diameter less than the diameter of the lower chamber, and wherein the passageway comprises the clearance between the disc and the inner surface of the case.

6. The primer valve of claim 1 wherein the partition comprises a removable disc and the diaphragm is dimensioned for positioning adjacent the disc case for retaining the diaphragm in a first position of adjustment in which it seals off the valve seat and a second position wherein it seals off the conduit.

7. The primer valve of claim 1 including floating separator means positioned inside the valve-actuating trapped air chamber and operable to separate the air and water phases contained therein.

8. The primer valve of claim 1 wherein the conduit comprises a tube centrally located in the actuating trapped air chamber and including an air-water separator comprising a floating plate with associated sleeve slidably mounted on the tube.

* * * * *